United States Patent [19]

Ruegsegger

[11] 4,427,964

[45] Jan. 24, 1984

[54] FUSIBLE LINK ASSEMBLY

[76] Inventor: Donald R. Ruegsegger, 425 W. Maple St., Waterloo, Ind. 46793

[21] Appl. No.: 306,161

[22] Filed: Sep. 28, 1981

[51] Int. Cl.[3] ..... H01H 85/16

[52] U.S. Cl. ..... 337/231; 337/232; 337/405

[58] Field of Search ..... 337/231, 232, 405, 233, 337/227, 237; 29/623

[56] References Cited

U.S. PATENT DOCUMENTS

| | | | |
|---|---|---|---|
| 797,324 | 8/1905 | Sachs | 337/232 |
| 2,916,587 | 12/1959 | Bernstein | 337/232 |
| 2,974,208 | 3/1961 | Sunot | 337/231 X |
| 3,179,774 | 4/1965 | Swain | 337/231 X |
| 3,253,103 | 5/1966 | Fister | 337/232 X |

*Primary Examiner*—George Harris

*Attorney, Agent, or Firm*—Larry J. Palguta; John A. Young

[57] ABSTRACT

A method for fabricating a fusible link assembly which includes a sleeve with a flanged end for receiving a solder rod and a smaller opening at the opposite end for receiving a conductor wire. The wire is placed through the smaller end of the sleeve and is held in position mechanically while solder is supplied at the flanged end to form a rigid connection between the rod and the wire through a soldered connection with the sleeve which acts as the intermediate connection.

5 Claims, 6 Drawing Figures

FIG. 1
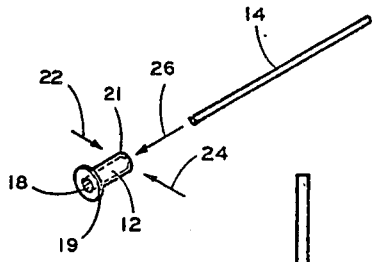
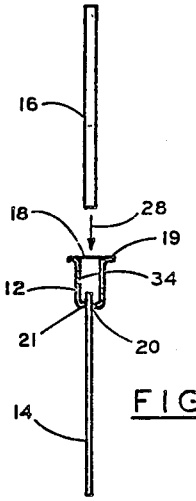
FIG. 2
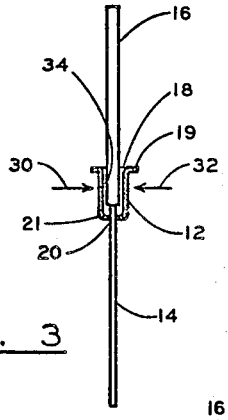
FIG. 3
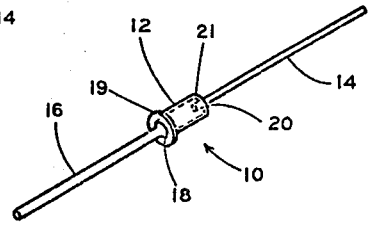
FIG. 4

FIG. 5
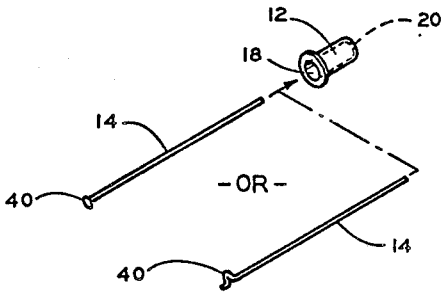
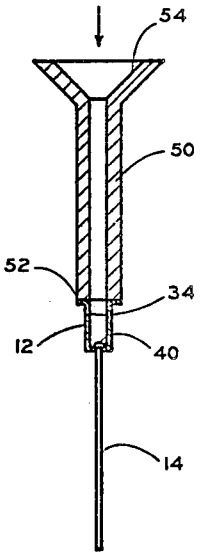
FIG. 6

FUSIBLE LINK ASSEMBLY

BACKGROUND OF THE INVENTION

Fusible link assemblies have found widespread application in electrical and mechanical apparatus subject to temperature control.

In the construction of fusible, temperature-responsive fuses, the basic purpose is to effect either a mechanical or electrical rupture at a critical temperature in order to carry out some function such as commencement of a sprinkler system or the like.

The difficulty is how to join a solder rod and a flexible conductor wire so that the connection therebetween allows for slight flexible movement without fracturing the relatively brittle solder rod and effect at the same time a connection which is stable and reliable and has an electrical conductivity of reproducible and consistent value.

It is an essential feature of a fuse that it be responsive reliably and consistently to a given set of heat conditions and that it be manufactured by processes which will be inexpensive yet able to produce a highly consistent product.

One such fusible fastener is applicant's Ruegsegger U.S. Pat. No. 2,666,488, issued Jan. 19, 1954, titled "FUSIBLE FASTENER".

SUMMARY OF THE INVENTION

An object of this invention is to provide an improved assembly and fabricating method for producing a fusible link assembly.

Another object of this invention is to provide a readily mass-producible fusible link assembly for widespread industrial application.

Another object of this invention is to provide a fusible link assembly which allows flexing or vibration to occur between terminals and without affecting the conductivity or strength of the device.

Other objects and features of the invention will become apparent from a consideration of the following description which proceeds with reference to the accompanying drawings.

DETAILED DESCRIPTION OF THE DRAWINGS

FIG. 1 is a perspective view of the fusible sleeve and wire in preparation for first stage of assembly;

FIG. 2 is a cross sectional view of the assembled wire and sleeve in preparation for receiving a solder rod;

FIG. 3 is a cross sectional view of a fusible link assembly showing a solder rod in place within the sleeve in preparation for heating the sleeve to form the fusible link;

FIG. 4 is a perspective view of the completed fusible link assembly;

FIG. 5 is a perspective view of another embodiment of the fusible link assembly in which the wire is passed through the open end of the sleeve in preparation for insertion through the sleeve; and, FIG. 6 is a cross sectional view of the wire and sleeve with a mandrel positioned for forming the solder within the sleeve and providing a solder link extending from the sleeve.

DETAILED DESCRIPTION OF THE INVENTION

The invention consists of fusible link assembly designated generally by reference numeral 10 and includes a sleeve 12, conductor wire 14, and solder rod 16.

The flanged sleeve 12 includes an opening 18 located at the flanged end 19 and a central small diameter opening 20 located at the opposite end 21. Wire 14 passes through opening 20 and a force exerted in the direction of arrows 22, 24 is applied to the sleeve 12 to mechanically secure the wire 14 within the sleeve 12. The subassembled portion consisting of sleeve 12 and the gripped wire 14 is then placed as shown in FIG. 2 so that solder rod 16 is inserted through opening 18 into the sleeve 12.

Once the solder rod 16 is implaced within the sleeve 12, heat is applied to the sleeve 12 in the manner indicated schematically by arrows 30,32 in FIG. 3, which serves to heat the solder rod within the sleeve and form an internal fused solder connection, the fused product being shown in FIG. 4.

As can be seen from FIGS. 1–4, this fabricating technique is fast, simple, and capable of producing fusible links in large quantities with a minimum of cost.

An alternate fabricating method shown in FIGS. 5,6, provides an alternate means of fabricating the solder wire in situ within the sleeve.

As shown in FIG. 5, wire 14 is crimped on one end 40 and is inserted through the large opening in the sleeve 12 so that sleeve 12 need not be crimped to retain wire 14.

Mandrel 50 is then placed over the flanged end of sleeve 12 as shown in FIG. 6, so that solder may be poured through mandrel at end 54. Solder will flow into sleeve 12 and be filled within mandrel 50 to form a solder connection in situ which extends beyond the sleeve. This alternate method is important where cost is a critical factor in fabrication. Solder rod is far more expensive than solder in bulk. Thus, solder may be formed in situ within the sleeve and extend beyond the sleeve to form a fusible link without requiring the use of solder rod.

With either fabrication technique, it can readily be seen that the results are similar. The temperature melting characteristics of the solder can be readily controlled with either manufacturing technique, and the resulting fusible link assembly can be adapted for use in a minimum of space.

This technique eliminates the expensive and timeconsuming task of winding the wire about the solder wire and securing an adequate temperature-sensitive seal therebetween.

The fusible link assembly provides a flexible connection between electrical terminals, providing for flexing and vibration of wire 14, that would crack or break a direct solder connection.

Because the solder rod tends to be brittle and inflexible when used directly between electrical terminals, it is not a satisfactory fusible link by itself, but its lack of resilience is compensated by the wire 14.

OPERATION OF THE INVENTION

The fusible link assembly 10 is secured between terminals, providing a flexible fuse which is sensitive to the ohmic resistance passing through the assembly.

The melting point of the solder and the diameter of solder used determine the melting or breaking point of the solder rod.

When the ohmic resistance causes sufficient heat passing through the fusible link assembly, the solder rod 16 melts, breaking the connection.

When used as a mechanical linkage, external thermal heat will affect the solder rod, releasing the connection.

Flexing and vibration of the fusible link assembly is absorbed by wire 14 without damaging solder rod 16, as would occur with a direct solder linkage.

The invention obviates the need for any hand-winding operation in producing the connections.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations be included within the scope of the following claims.

What is claimed is:

1. A method of manufacturing a fusible link assembly which comprises:

(a) forming a sleeve adapted to receive solder wire at one end and a reduced diameter wire at the opposite end;

(b) placing a reduced diameter wire through a reduced diameter opening provided in the sleeve;

(c) crimping the sleeve to secure the reduced diameter wire within the sleeve;

(d) inserting a solder wire into the enlarged end of the sleeve; and (e) heating the sleeve to melt the solder wire within the sleeve to form a fusible link assembly.

2. A method for fabricating a fusible link assembly which comprises:

(a) placing a sleeve having an enlarged diameter opening at one end, and a reduced diameter opening at the other end, in position for receipt of solder through the enlarged end;

(b) forming one end of a wire so that the formed portion of the wire will not pass through the reduced opening in one end of the sleeve;

(c) inserting the unformed portion of the wire through the sleeve so that solder cannot pass through the reduced opening with the wire therein;

(d) positioning a mandrel over the sleeve to receive a solder flux;

(e) pouring solder through the mandrel and into the sleeve to form a fusible link with the wire; and (f) pouring sufficient solder within the mandrel to provide a solder link extending beyond the sleeve.

3. A method for fabricating a fusible link as described in claims 1 or 2 wherein the sleeve includes a flange on the enlarged opening to aid insertion of solder.

4. A temperature sensitive fusible link assembly comprising:

(a) a sleeve having an opening at one end of the sleeve and approximately the inner diameter of the sleeve, and an opening of a reduced diameter at the opposite end of the sleeve;

(b) wire means having one end inserted through the reduced diameter opening of the sleeve;

(c) a solder wire fuse with one end received through the larger opening of the sleeve; and (d) a fused bond between the ends of the solder wire fuse and wire means disposed within the sleeve and comprising the conjoint product of a heat source having been applied to said sleeve after insertion of the ends of the wire means and solder wire fuse.

5. A temperature sensitive fusible link assembly which comprises:

(a) solder fuse means whose melting characteristics and diameter are predetermined to provide melting when the ohmic resistance within the fuse means or ambient temperature exceeds a desired amount;

(b) a flexible conductor capable of conducting electric current;

(c) a sleeve receiving an end of the solder fuse means at one end and an end of the flexible conductor at the other end; and (d) a fused bond connecting the solder fuse means to the flexible conductor to form the fusible link assembly, said bond resulting from melted solder fuse means engaging the end of the conductor to form a connection internally of said sleeve.

* * * * *